US006193530B1

(12) United States Patent
Sakurai et al.

(10) Patent No.: US 6,193,530 B1
(45) Date of Patent: Feb. 27, 2001

(54) CONNECTOR MATING STRUCTURE

(75) Inventors: Kazuaki Sakurai; Yoshinori Uchida; Hirofumi Yamauchi; Yoko Nakamura; Atsushi Sasaki; Hiroyuki Kanbayashi, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/293,988

(22) Filed: Apr. 19, 1999

(30) Foreign Application Priority Data

Apr. 20, 1998 (JP) ..... 10-109445

(51) Int. Cl.[7] ..... H01R 13/62

(52) U.S. Cl. ..... 439/157; 439/153; 439/310; 439/346

(58) Field of Search ..... 439/157, 153, 439/310, 311, 314, 346, 347

(56) References Cited

U.S. PATENT DOCUMENTS

| | | | | |
|---|---|---|---|---|
| 4,875,873 | | 10/1989 | Ishizuka et al. . | |
| 5,964,604 | * | 10/1999 | Kashiyama et al. | 439/157 |
| 5,989,044 | * | 11/1999 | Miyamoto | 439/157 |
| 6,068,497 | * | 5/2000 | Kodama | 439/157 |
| 6,102,717 | * | 8/2000 | Aoki et al. | 439/157 |

FOREIGN PATENT DOCUMENTS

| | | | | |
|---|---|---|---|---|
| 197 27 064 A1 | | 1/1998 | (DE) . | |
| 363804B1 | | 10/1989 | (EP) | H01R/13/629 |
| 825684A1 | * | 6/1997 | (EP) . | |
| 0 825 684 A1 | | 2/1998 | (EP) . | |
| 6-54255 | | 7/1994 | (JP) | H01R/13/629 |

* cited by examiner

*Primary Examiner*—Lincoln Donovan
*Assistant Examiner*—Kyung S. Lee
(74) *Attorney, Agent, or Firm*—Sughrue, Mion, Zinn, Macpeak & Seas, PLLC

(57) ABSTRACT

A female connector is provided with a first moving member and a second moving member which are capable of moving independently of each other, and the female connector is further provided with an operating member which is rotatable. The operating member is provided with a pair of first cam grooves whose spiral groove shapes are formed oppositely, while the first and second moving members are provided with first cam pins which are respectively inserted in the pair of first cam grooves. As the operating member is rotated, the first and second moving members are moved in mutually opposite directions. The first and second moving members are each provided with a pair of second cam grooves whose angles of inclination are opposite, while a male connector is provided with second cam pins which are inserted in the second cam grooves. As the first and second moving members are moved in the mutually opposite directions, a moving force acting in a connector-inserting direction is applied to the male connector through the cooperative movement of the first and second moving members.

17 Claims, 15 Drawing Sheets

CONNECTOR MATING STRUCTURE

BACKGROUND OF THE INVENTION

1. Field of the Invention

The present invention relates to a connector mating structure in which a movable moving member is provided on one of a female connector and a male connector, cam mechanisms are respectively provided on the moving member and the other connector, and the moving force of the moving member is converted to a connector inserting force by the cam mechanisms, so as to effect the engagement of the connector with a small manipulating force.

The present application is based on Japanese Patent Application No. Hei. 10-109445, which is incorporated herein by reference.

2. Description of the Related Art

FIGS. 13 to 17 show a connector mating structure of the above-described type, and also, the structure is disclosed in Unexamined Japanese Patent Publication No. Sho. 61-203581. FIG. 13 is a perspective view illustrating a state in which a female connector and a male connector are separated. FIG. 14 is a cross-sectional view illustrating an early state of engagement between the female connector and the male connector. FIG. 15 is a cross-sectional view illustrating an intermediate state of engagement therebetween. FIG. 16 is a cross-sectional view illustrating a completed state of the engagement. FIG. 17 is a diagram illustrating a direction of pressing by cam mechanism.

In FIGS. 13 to 16, a connector accommodating chamber 4 for accommodating a male connector 3 is provided in a female housing 2 of a female connector 1, and an inserting port 4*a* for insertion of the connector is open in the connector accommodating chamber 4. Elongated holes 5 for moving are respectively formed in opposite side walls of the female housing 2, and cam pins 7 of a moving member 6 are respectively inserted in the elongated holes 5. The moving member 6 comprises a pair of side plate portions 6*a* which are respectively disposed on the outer sides of the opposite side walls of the female housing 2 and a connecting plate portion 6*b* for connecting the pair of side plate portions 6*a*. The aforementioned cam pins 7 are provided on the inner surfaces of the pair of side plate portions 6*a*. As the cam pins 7 are guided and restricted by the elongated holes 5 for moving and the like, the moving member 6 moves in a direction perpendicular to a connector-inserting direction with respect to the female connector 1.

Cam grooves 9 are respectively provided in opposite side walls of a male housing 8 of the male connector 3, and each of the pair of cam grooves 9 has a straight groove portion 9*a* oriented in the same direction as the connector-inserting direction and an inclined groove portion 9*b* which is inclined with respect to the connector-inserting direction. The cam mechanism is formed by the pair of cam grooves 9 and the aforementioned cam pins 7.

Next, a description will be given of the engaging operation of the above-described connector mating structure with reference to FIGS. 14 to 16. As shown in FIG. 14, the moving member 6 is fitted in the female connector 1, and the male connector 3 is inserted into the connector accommodating chamber 4 of the female connector 1 through the inserting port 4*a*. Then, the cam pins 7 of the moving member 6 are inserted into the cam grooves 9 on both sides of the male connector 3, and the cam pins 7 of the male connector 3 respectively pass through the straight groove portions 9*a* of the cam grooves 9 and are inserted up to immediately before the inclined groove portions 9*b*, as shown in FIG. 15.

Next, if the moving member 6 is moved in the direction of arrow in FIG. 15, the cam pins 7 are subjected to a pressing force by the inclined groove portions 9*b*, and the male connector 3 is pulled into the connector accommodating chamber 4 of the female connector 1 by a component of this pressing force. Then, when the moving member 6 is moved to the position shown in FIG. 16, the cam pins 7 reach the terminating ends of the inclined groove portions 9*b*, and the engagement of the connector is thereby completed. In addition, terminals (not shown) are respectively provided inside the housings 2 and 8 of the connectors 1 and 3, both terminals are set in a state of pressure contact with each other in this engaging process, thereby allowing the terminals to electrically conduct with each other.

In the above-described connector mating structure, however, since all the inclined groove portions 9*b* of the cam grooves 9 of the moving member 6 are inclined in the same direction, all the directions in which the cam pins 7 are pressed assume the same direction. Accordingly, as shown in FIG. 17, of components f1 and f2 of a pressing force F, the component f1 which does not act in the connector pulling-in direction acts in the same direction in all the inclined groove portions 9*b*, and the resultant of these components f1 acts on the male connector 3 and on the female connector 1 through the male connector 3. Since the connector is engaged in the state in which the female connector 1 or the male connector 3 is normally attached to a baseplate or the like, a trouble can occur such as the breakage of an attached portion by the resultant of the components f1.

In addition, since the connecting plate portion 6*b* of the moving member 6 is located in such a manner as to project in an area located above (a lower position in FIGS. 14 to 16) the inserting port 4*a* before and after the engagement of the connector, there is a case that the connecting plate portion 6*b* is a hindrance to the wiring, a jig or the like. In addition, since the connecting plate portion 6*b* of the moving member 6 moves in the area located above (the lower position in FIGS. 14 to 16) the inserting port 4*a*, the bundle of wires (not shown) extending from the rear of the male connector 3 has to be oriented in a direction in which the bundle of wires does not hamper the moving member 6, so that the engaging operation becomes troublesome.

SUMMARY OF THE INVENTION

Accordingly, it is an object of the present invention to provide a connector mating structure which permits engagement at a low inserting force without practically producing an external force other than the force acting in the engaging direction at the time of the engaging operation, thereby overcoming the above-described problems.

Another object of the present invention is to provide a connector mating structure in which a member for effecting engagement with a low inserting force, such as a moving member, does not cause a hindrance to the wiring, a jig, and the like and does not cause a hindrance to the bundle of wires of the connector.

To achieve the above objects, according to the first aspect of the present invention, there is provided a connector mating structure which comprises a female connector, a male connector insertable into the female connector, a first moving member and a second moving member which are provided on one of the male connector and the female connector and are movable independently from each other, an operating member pivotally mounted on the one of the male connector and the female connector, a pair of first cam mechanisms respectively connecting the operating member with the first and second moving members, the first cam mechanisms moving the first and second moving members respectively in mutually opposite directions in accordance with rotation of the operating member, and a pair of second cam mechanisms provided on the first and second moving members and the other one of the male connector and the female connector, the second cam mechanisms moving the other one of the male connector and the female connector in a connector-inserting direction as the first and the second moving members move in the mutually opposite directions.

In this connector mating structure, the male connector is inserted into the female connector until the second cam mechanisms are engaged, and if the operating member is rotated in this state, the first and the second moving members move in the mutually opposite directions by the first cam mechanisms, and a component of pressing force is made to act upon the other connector to move the other connector in the connector-inserting direction by the pair of second cam mechanisms. At the same time, components of pressing force which are separated from this component of force acting in the connector-inserting direction are set in the mutually opposite directions by the pair of second cam mechanisms since the moving directions of the first and the second moving members are mutually opposite.

In accordance with the above-described first aspect of the present invention, since components of pressing force other than the force acting in the connector-inserting direction are offset by each other, and an external force other than the force acting in the connector-inserting direction does not occur in the apparatus as a whole, so that the trouble such as the occurrence of breakage of an attached portion of the connector is prevented from occurring during the engaging operation of the connector.

According to the second aspect of the present invention, in the connector mating structure according to the first aspect of the present invention, preferably, the one of the male connector and the female connector has a connector accommodating chamber for accommodating the other connector within a housing thereof, an inserting port, which allows the other connector to be inserted, is open in the connector accommodating chamber, and accommodating area for accommodating the operating member is formed in the housing, and wherein a path of the rotation of the operating member is set to be practically within the accommodating area, and the operating member does not pass through an area located above the inserting port.

In this connector mating structure, since the operating member is disposed in the accommodating area of the housing, and even if the operating member is rotated, the operating member rotates practically within the accommodating area and in such a manner as not to pass through an area located above the area located above the inserting port, so that the operating member does not project into the area located above the inserting port or move therethrough.

In accordance with the above-described second aspect of the present invention, since the operating member does not project into the area located above the inserting port or does not move in the upwardly located area, the movement of the operating member does not cause a hindrance to the wire and a jig or the like, and the possibility of breakage or the like due to contact with another component part is practically nil.

According to the third aspect of the present invention, in the connector mating structure according to the first or second aspect of the present invention, preferably, the male connector is arranged to be insertable into the female connector from an inserting starting position to an engagement completed position through a temporary engaged position, the connector mating structure further comprises terminals accommodated in the male connector and the female connector, wherein the terminals are set to such a positional relationship that contact therebetween does not occur in a process of insertion of the male connector from the inserting starting position to the temporary engaged position, and wherein the insertion of the male connector from the temporary engaged position to the engagement completed position is effected by the rotation of the operating member.

In this connector mating structure, in the process of the insertion of the male connector into the female connector from the insertion starting position to the temporary engaged position, reaction force based on the resistance of pressure contact between the terminals is not applied to the two connectors, and the contact between the terminals is effected in the process of insertion from the temporary engaged position to the engagement completed position, in which process a large inserting force is obtained by the cam mechanisms.

In accordance with the above-described third aspect of the present invention, since in the process of insertion of the male connector from the insertion starting position to the temporary engaged position, the terminals of the male and female connectors does not occur, and the connector-inserting operation can be performed with a small inserting force. In addition, since the contact between the terminals is effected in the process of insertion from the temporary engaged position to the engagement completed position, in which process a large inserting force is obtained by the cam mechanisms, the engaging operation as a whole can be performed with a small inserting force smoothly and easily.

According to the fourth aspect of the present invention, in the connector mating structure according to one of first to third aspects of the present invention, preferably, the first and the second moving members are disposed at symmetrical positions on both sides of the one of the male connector and the female connector.

In this connector mating structure, components of pressing force in the connector pulling-in direction by the pair of second cam mechanisms act at symmetrical positions on both sides of the other connector.

In accordance with the above-described fourth aspect of the present invention, since the components of pressing force in the connector pulling-in direction by the pair of guide grooves or the pair of guide pins act at symmetrical positions on both sides of the other connector, the connector engaging force acts substantially uniformly as a whole, so that the engaging operation can be performed smoothly.

According to the fifth aspect of the present invention, in the connector mating structure according to one of first to fourth aspects of the present invention, preferably, the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

In this connector mating structure, the first cam pins are guided in a state of being inserted in the first cam grooves.

In accordance with the above-described fifth aspect of the present invention, in addition to the advantages derived from the first to fourth aspects of the invention, it is possible to obtain an advantage in that the movement of the first cam pins can be effected reliably since the first cam pins are guided in the state of being inserted in the first cam grooves.

According to the sixth aspect of the present invention, in the connector mating structure according to one of first to fifth aspects of the present invention, preferably, the pair of second cam mechanisms comprise a pair of second cam grooves provided in one of the first and the second moving members and the other one of the male connector and the female connector, and a pair of second cam pins provided in the other one of the first and the second moving members and the other one of the male connector and the female connector and arranged to be inserted into the pair of second cam grooves.

In this connector mating structure, the second cam pins are guided in a state of being inserted in the second cam grooves.

In accordance with the above-described sixth aspect of the present invention, in addition to the advantages derived from the first to fifth aspects of the invention, it is possible to obtain an advantage in that the movement of the second cam pins can be effected reliably since the second cam pins are guided in the state of being inserted in the second cam grooves.

The above and other objects, features and advantages of the present invention will become more apparent from the following detailed description of the invention when read in conjunction with the accompanying drawings.

DETAILED DESCRIPTION OF THE PREFERRED EMBODIMENTS

Referring now to the accompanying drawings, a detailed description will be given of an embodiment of the present invention.

Figure 1:
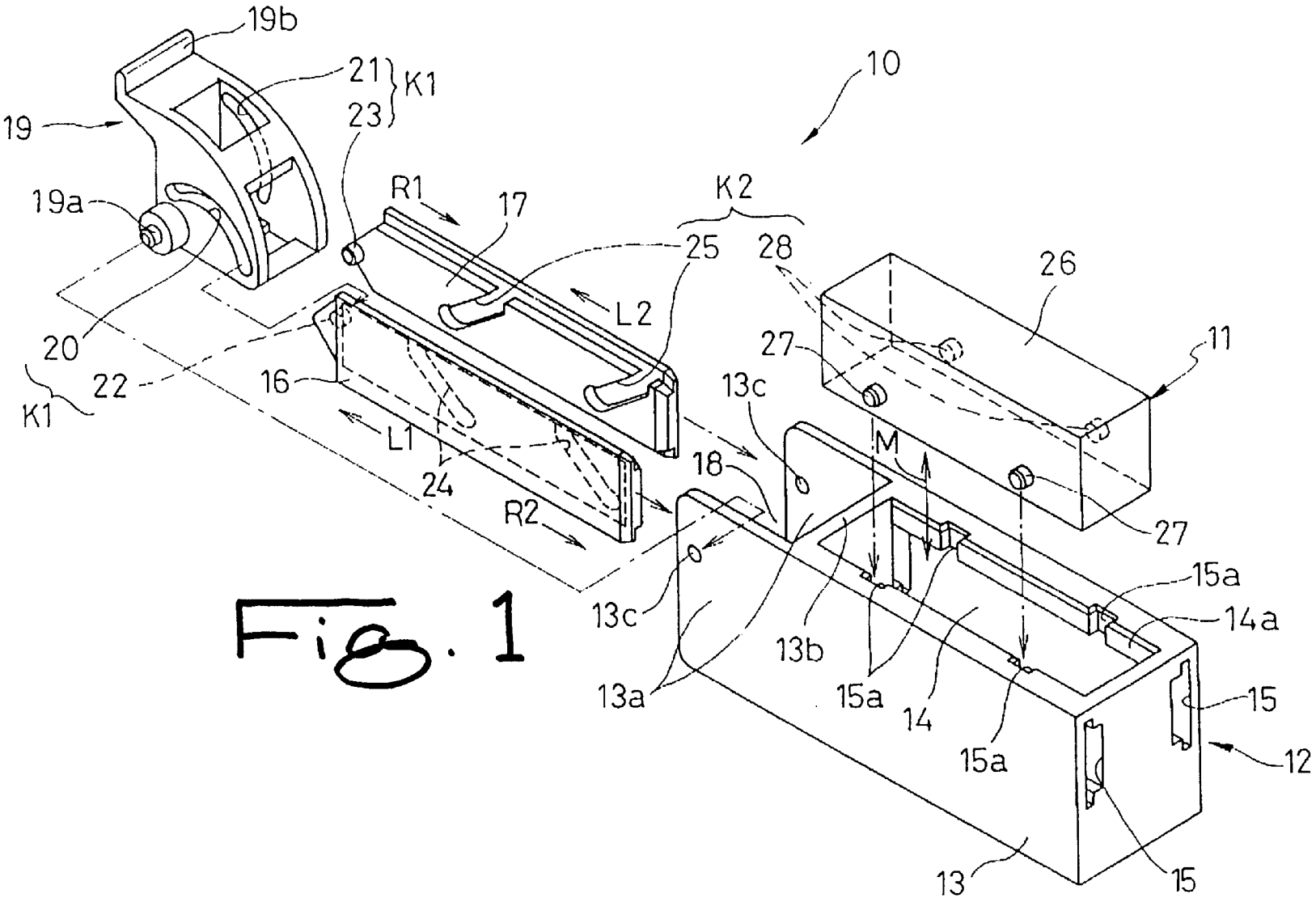
FIG. 1 is an exploded perspective view of a connector mating structure in accordance with an embodiment of the present invention.
Figure 2:
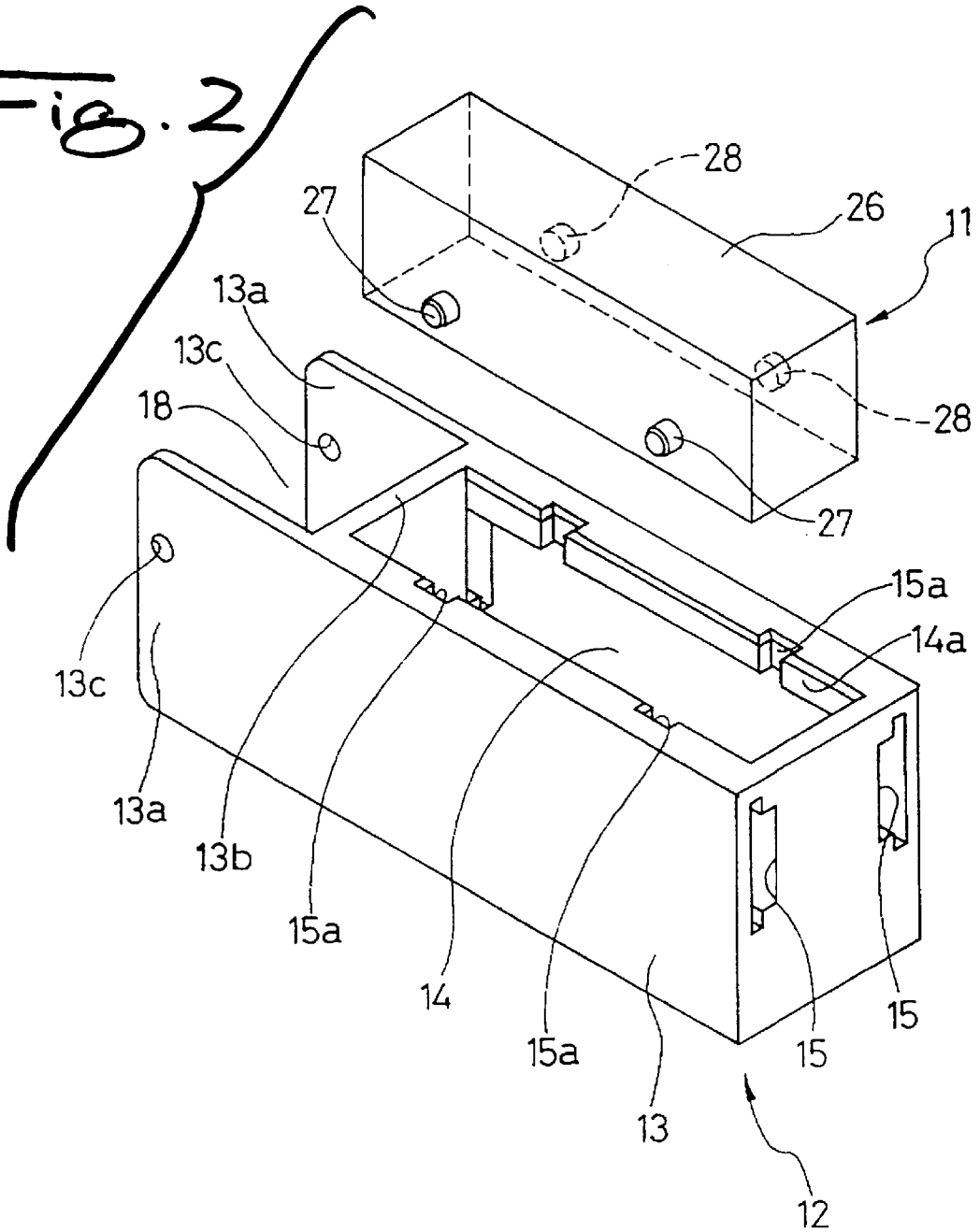
FIG. 2 is an exploded perspective view of a male connector and a female housing of a female connector in accordance with the embodiment of the present invention.
Figure 3:
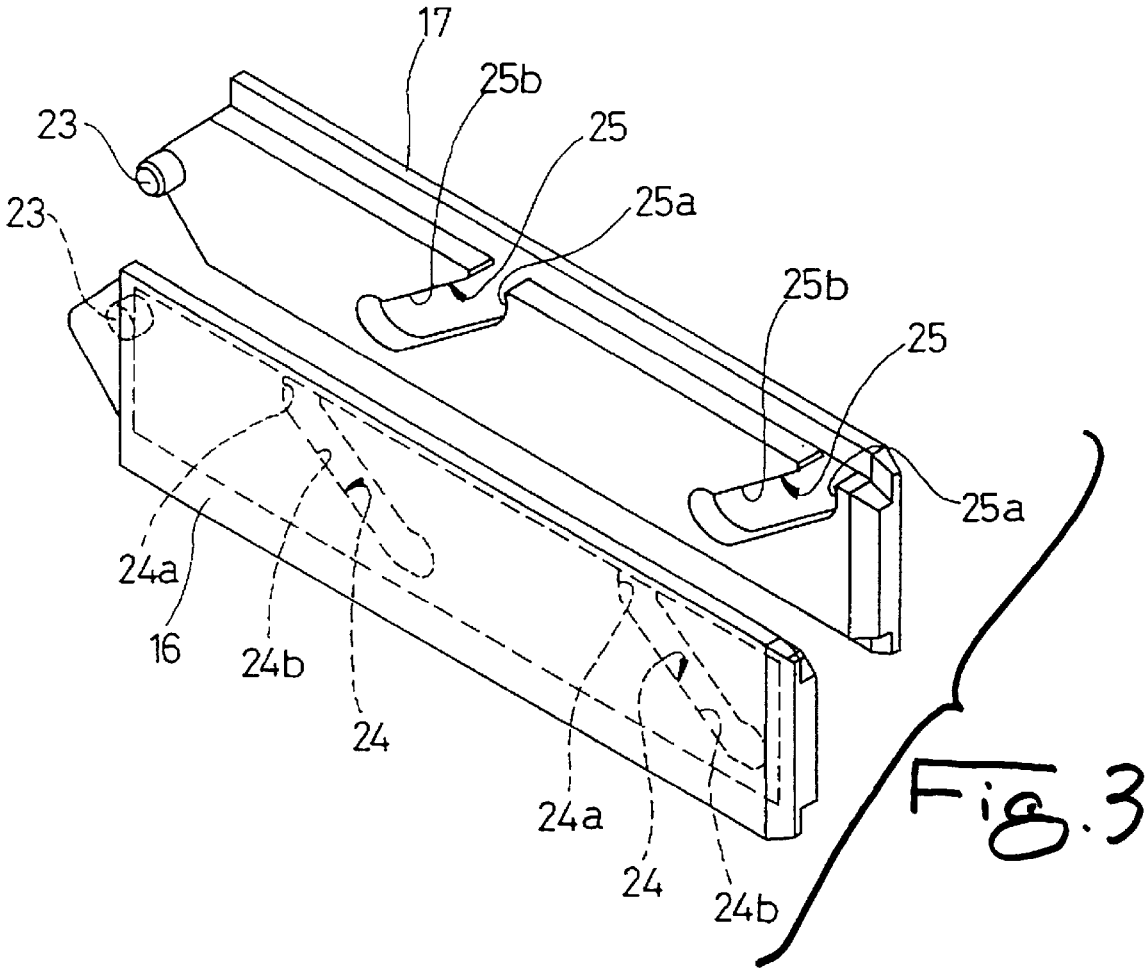
FIG. 3 is a perspective view of first and second moving members in accordance with the embodiment of the present invention.
Figure 4:
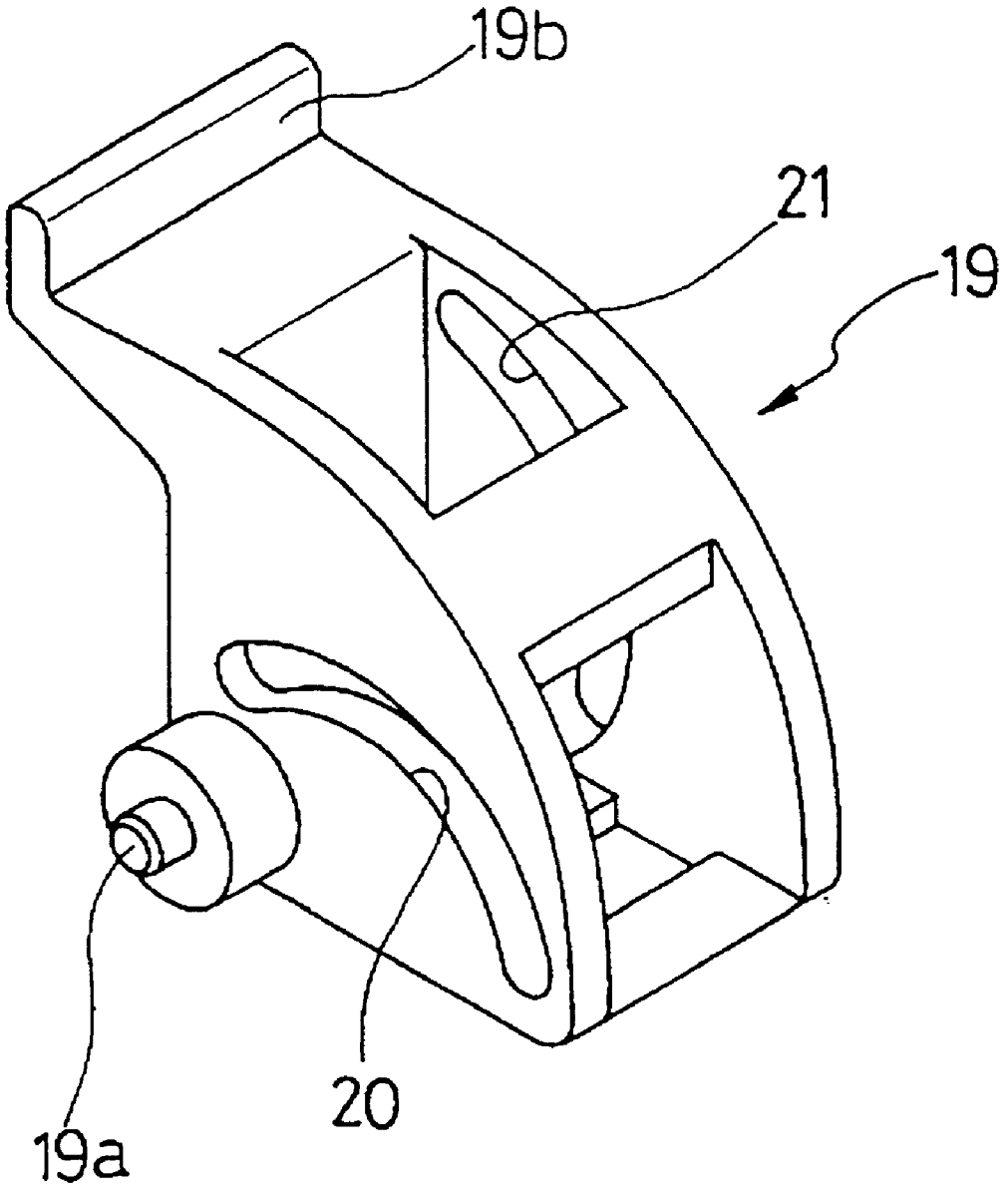
FIG. 4 is a perspective view of an operating member in accordance with the embodiment of the present invention.

FIG. 1 is an exploded perspective view of a connector mating structure in accordance with an embodiment of the present invention. FIG. 2 is a perspective view of a male connector and a female housing of a female connector. FIG. 3 is a perspective view of first and second moving members. FIG. 4 is a perspective view of an operating member. In FIGS. 1 to 4, a connector mating structure 10 comprises a male connector 11 and a female connector 12, and the male connector 11 is arranged to be insertable into the female connector 12 from an insertion starting position until an engagement completed position through a temporary engaged position. A connector accommodating chamber 14 for accommodating the male connector 11 is provided inside a female housing 13 of the female connector 12, and one side of this connector accommodating chamber 14 is made open and is formed as an inserting port 14*a*.

A pair of moving chambers 15 are respectively formed in the female housing 13 and in opposite-side spaces of the connector accommodating chamber 14, and inner surface sides of the moving chambers 15 are open to the connector accommodating chamber 14. In addition, two pairs of guide ports 15*a* for insertion of second cam pins, which will be described later, are respectively formed on both sides of the inserting port 14*a* of the female housing 13, and each of these guide ports 15*a* has one surface open to the inserting port 14*a* and is open to each moving chamber 15. A first moving member (slider) 16 and a second moving member (slider) 17 are respectively disposed in the pair of moving chambers 15, and the first and second moving members 16 and 17 are arranged to be mutually independently movable in a direction perpendicular to a connector-inserting direction. Namely, the first and second moving members 16 and 17 are disposed at symmetrical positions on both sides of the female connector 12.

In addition, the female housing 13 has a pair of projecting wall portions 13*a*, and an accommodating area 18 is formed between these projecting wall portions 13*a*. This accommodating area 18 is adjacent to the connector accommodating chamber 14 via a partition wall 13*b*, and a pair of rotation supporting holes 13*c* are respectively formed in the projecting wall portions 13*a*.

An operating member 19 has a pair of rotation supporting pins 19*a* on its both side surfaces, and these rotation supporting pins 19*a* are inserted in the respective rotation supporting holes 13*c*. The operating member 19 rotates about the rotation supporting pins 19*a* between an operation starting position shown in FIG. 7 and an operation completed position shown in FIG. 11, and a path of its rotation is set to be practically within the aforementioned accommodating area 18 and such that it does not pass through the area located above the aforementioned inserting port 14*a*. Further, a knob operating portion 19*b* is provided at a rotating tip of the operating member 19, and this knob operating portion 19*b* at its operation completed position abuts against an upper surface of the aforementioned partition wall 13*b*. Namely, the knob operating portion 19*b* also serves as a rotation restricting mechanism.

In addition, the operating member 19 and the first and second moving members 16 and 17 are connected to each other by a pair of first cam mechanisms K1. The pair of first cam mechanisms K1 comprise first cam grooves 20 and 21 respectively provided in both side surfaces of the operating member 19 as well as first cam pins 22 and 23 which are provided on one ends of the first and second moving members 16 and 17 and are respectively inserted in the first cam grooves 20 and 21. The spirally shaped grooves of the pair of first cam grooves 20 and 21 are set reversely so that the first and second moving members 16 and 17 move in the mutually opposite directions as the operating member 19 rotates.

Figure 5A:
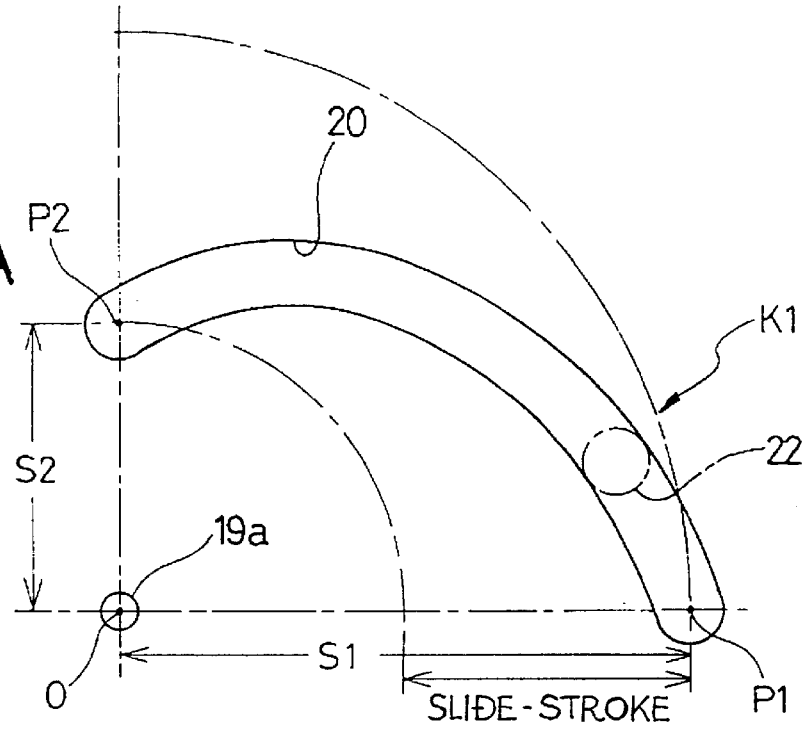
FIGS. 5A and 5B are diagrams illustrating configurations of first cam grooves in accordance with the embodiment of the present invention.
Figure 5B:
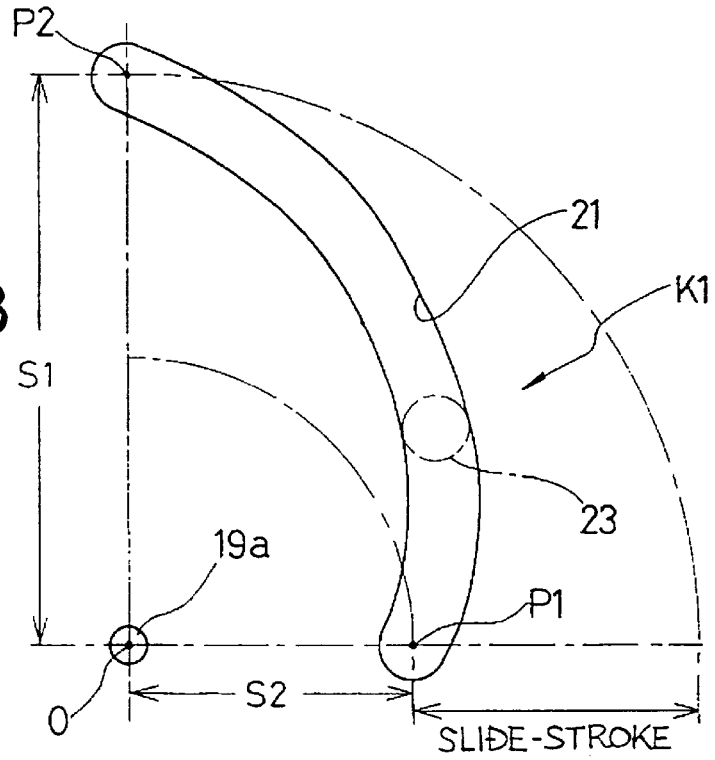

More specifically, as shown in FIGS. 5A and 5B, each of the first cam grooves 20 and 21 has a 90-degree angle of rotation about its center of rotation, and is formed in a spiral curve whose distance to the center of rotation (O) changes gradually from one end toward the other end. Specifically, as shown in FIG. 5A, one first cam groove 20 is arranged such that the distance from one end P1 thereof to the center of rotation (O) is set to be the longest (S1), while the distance from the other end P2 thereof to the center of rotation is set to be the shortest (S2). On the other hand, the other first cam groove 21 is arranged such that the distance from one end P1 thereof to the center of rotation (O) is set to be the shortest (S2), while the distance from the other end P2 thereof to the center of rotation is set to be the longest (S1).

Due to the arrangement of such a pair of first cam grooves 20 and 21, in the rotation of the operating member 19 from the operation starting position to the operation completed position, the first moving member 16 moves in the direction of arrow L1 in FIG. 1, while the second moving member 17 moves in the direction of arrow R1 in FIG. 1 (the pattern of the movement of the first and second moving members 16 and 17 in this operation will be referred to as a first pattern). On the other hand, in the rotation of the operating member 19 from the operation completed position to the operation starting position, the first moving member 16 moves in the direction of arrow R2 in FIG. 1, while the second moving member 17 moves in the direction of arrow L2 in FIG. 1 (the pattern of the movement of the first and second moving members 16 and 17 in this operation will be referred to as a second pattern).

The first and second moving members 16 and 17 are provided with a pair of second cam mechanisms K2 which operate when the male connector 11 is inserted. This pair of second cam mechanisms K2 comprise a pair of second cam grooves 24 and a pair of second grooves 25 which are respectively provided on inner surface sides of the first and second moving members 16 and 17 as well as a pair of second cam pins 27 and a pair of second cam pins 28 which are respectively provided on both side surfaces of a male housing 26 of the male connector 11. Each of these second cam grooves 24 and 25 has a straight groove portion 24*a*, 25*a* oriented in the same direction as the connector-inserting direction and an inclined groove portion 24*b*, 25*b* which is inclined with respect to the connector-inserting direction. However, the directions of inclination of the inclined groove portions 24*b* of the first moving member and the inclined groove portions 25*b* of the second moving member 17 are set to be in the mutually opposite directions so that the directions of components of the pressing force for pressing the male connector 11 due to the movement in the above-described first pattern coincide with the connector-inserting direction.

Figure 6B:
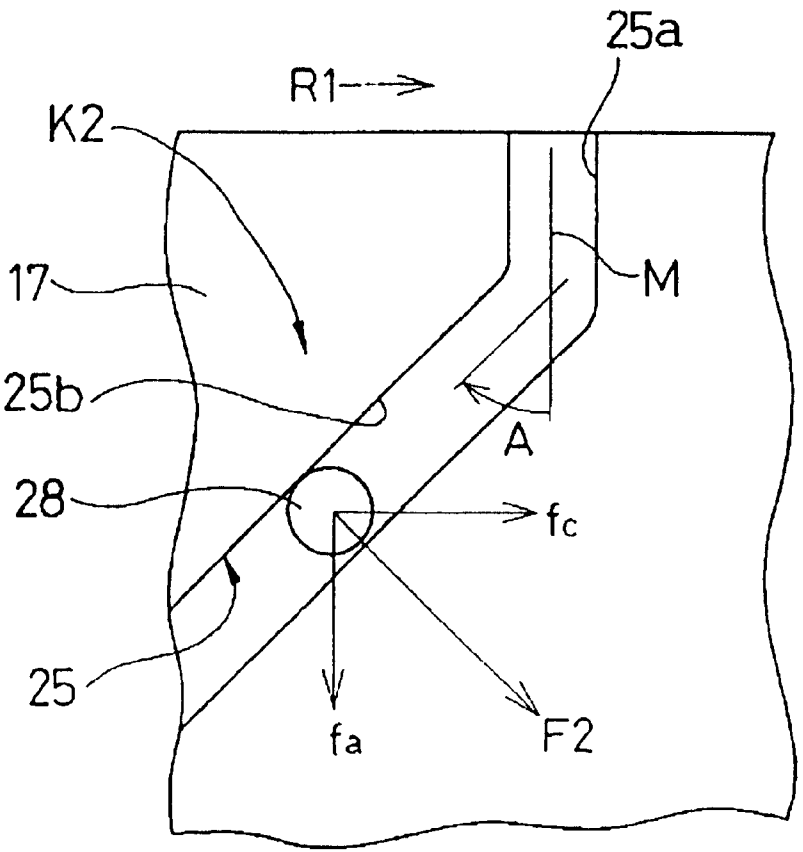
FIGS. 6A and 6B are diagrams explaining the pressing direction of the second cam mechanisms in accordance with the embodiment of the present invention.
Figure 6A:
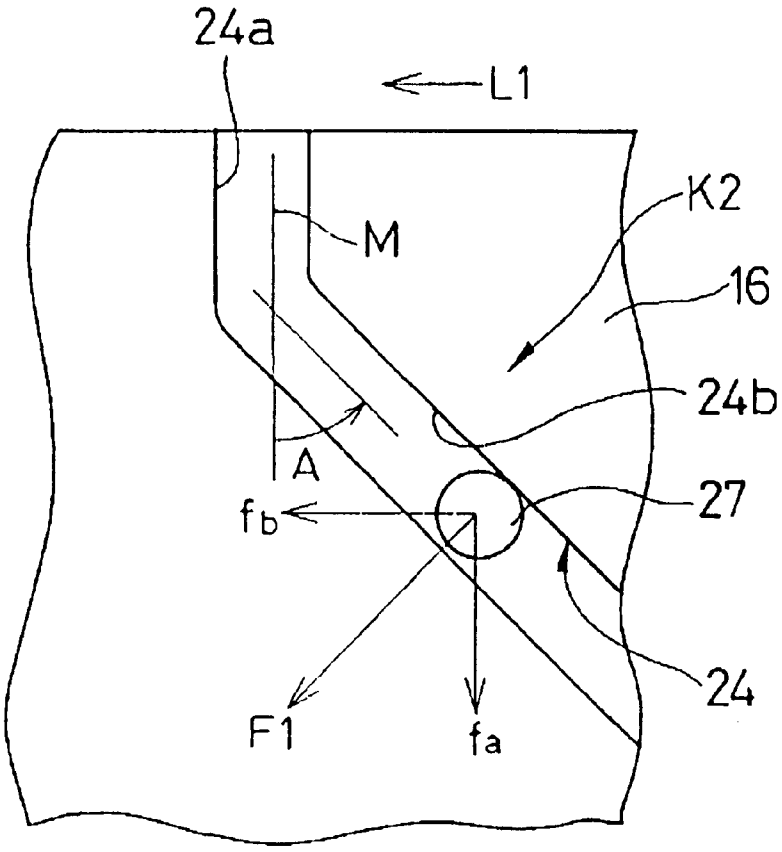

More specifically, as shown in FIG. 6A, one inclined groove portion 24*b* has an inclination of an angle of inclination, A, in the counterclockwise direction with respect to the connector-inserting direction M. Meanwhile, as shown in FIG. 6B, the other inclined groove portion 25*b* has an inclination of an angle of inclination, A, in the clockwise direction with respect to the connector-inserting direction M. Incidentally, pin terminating portions (not denoted by reference numerals) oriented in the same direction as the moving direction of the sliders 16 and 17 are respectively formed on the innermost sides of the second cam grooves 24 and 25.

In addition, the male connector 11 is provided with a crimp terminal (not shown) which is a female terminal, while the female connector 12 is provided with a pin terminal (not shown) which is a male terminal. In the process of connector insertion from the insertion starting position to the temporary engaged position, the male terminal and the female terminal are set in such a positional relationship that contact between the male and female terminals does not occur.

Figure 7:
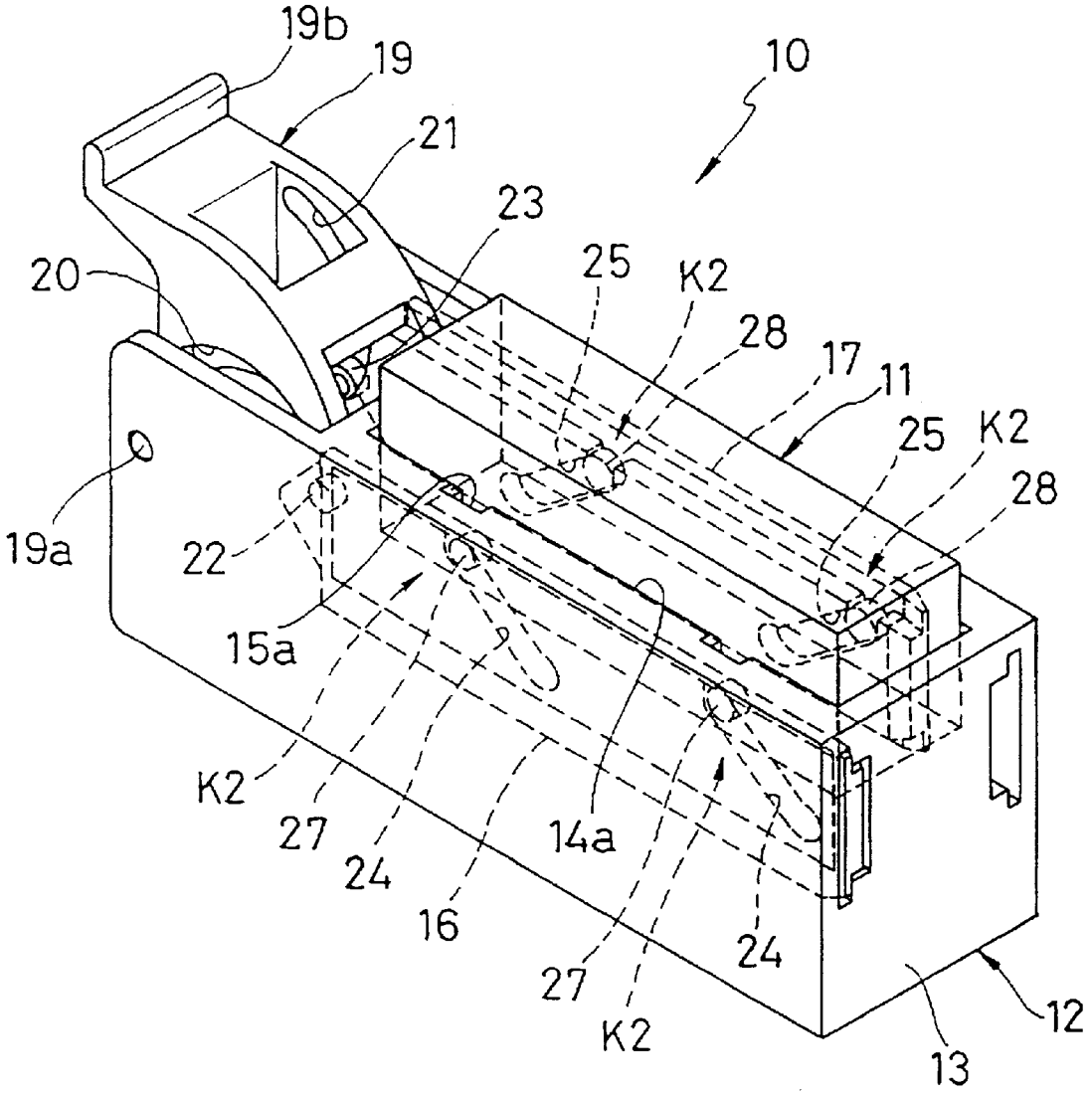
FIG. 7 is a perspective view of the connector mating structure in which the male connector is in a temporary engaged position in accordance with the embodiment of the present invention.
Figure 8:
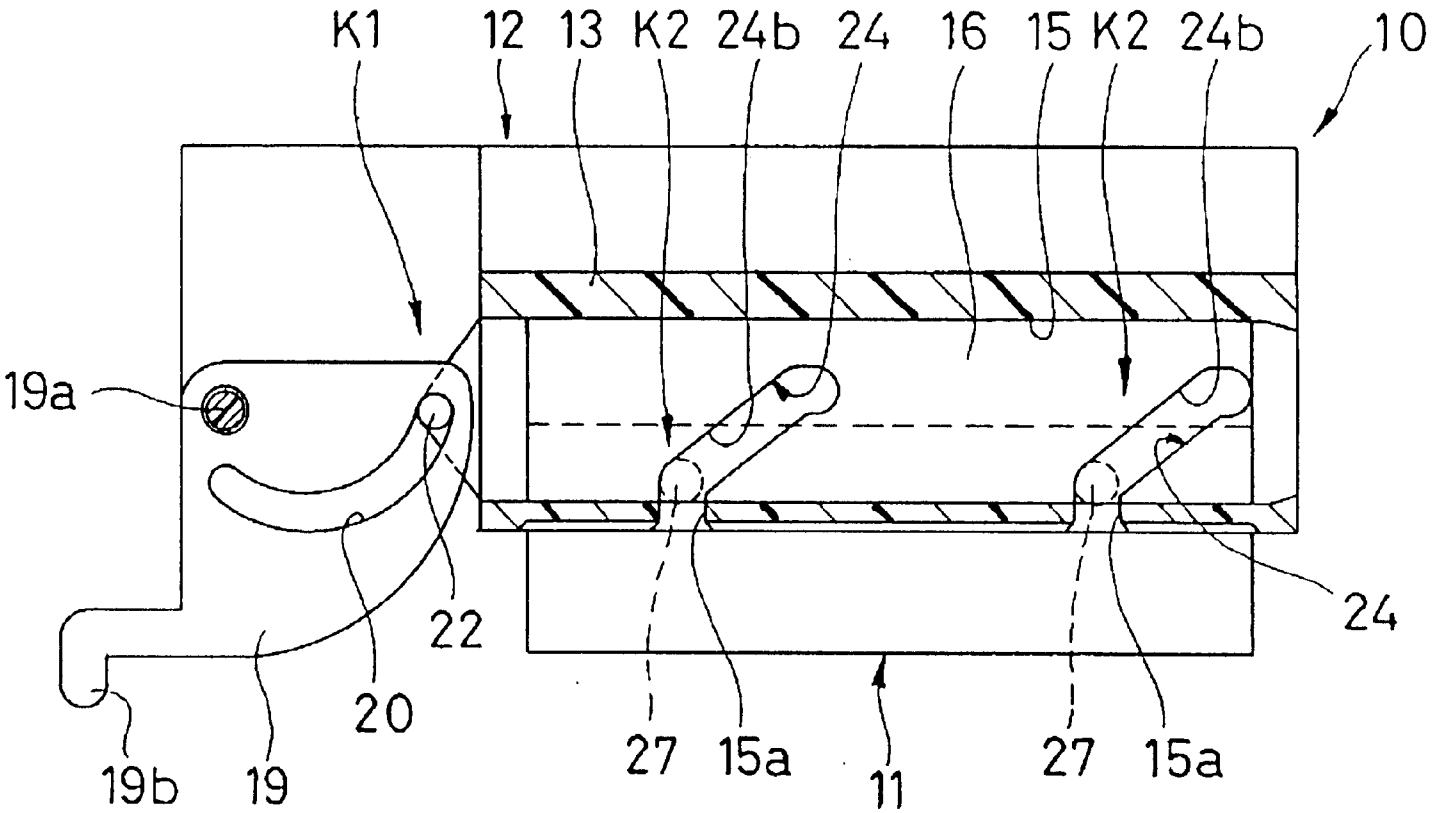
FIG. 8 is a cross-sectional view of the connector mating structure in which the male connector is in the temporary engaged position in accordance with the embodiment of the present invention.
Figure 10:
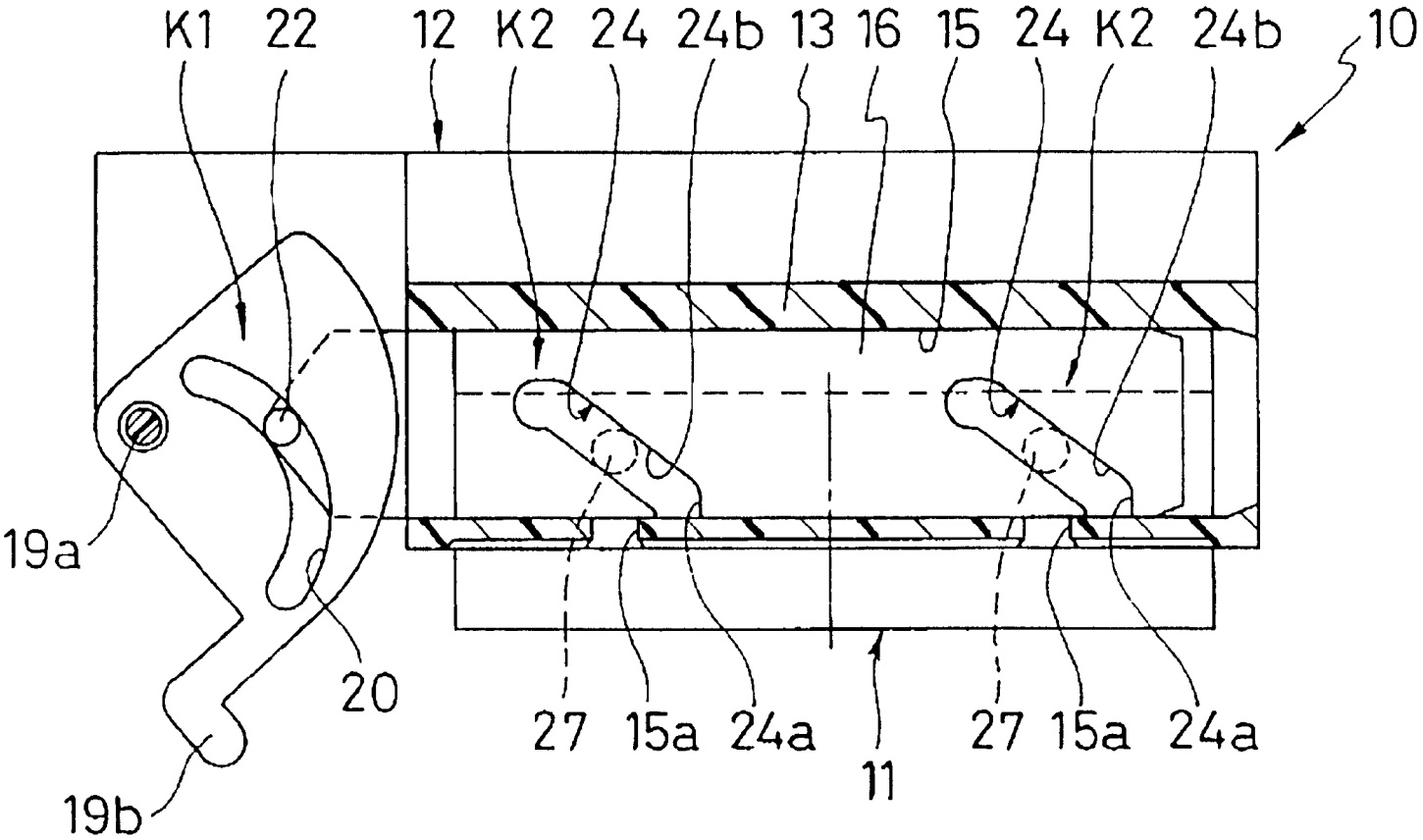
FIG. 10 is a cross-sectional view of the connector mating structure in which the male connector is in the intermediate position between the temporary engaged position and the engaged position in accordance with the embodiment of the present invention.
Figure 11:
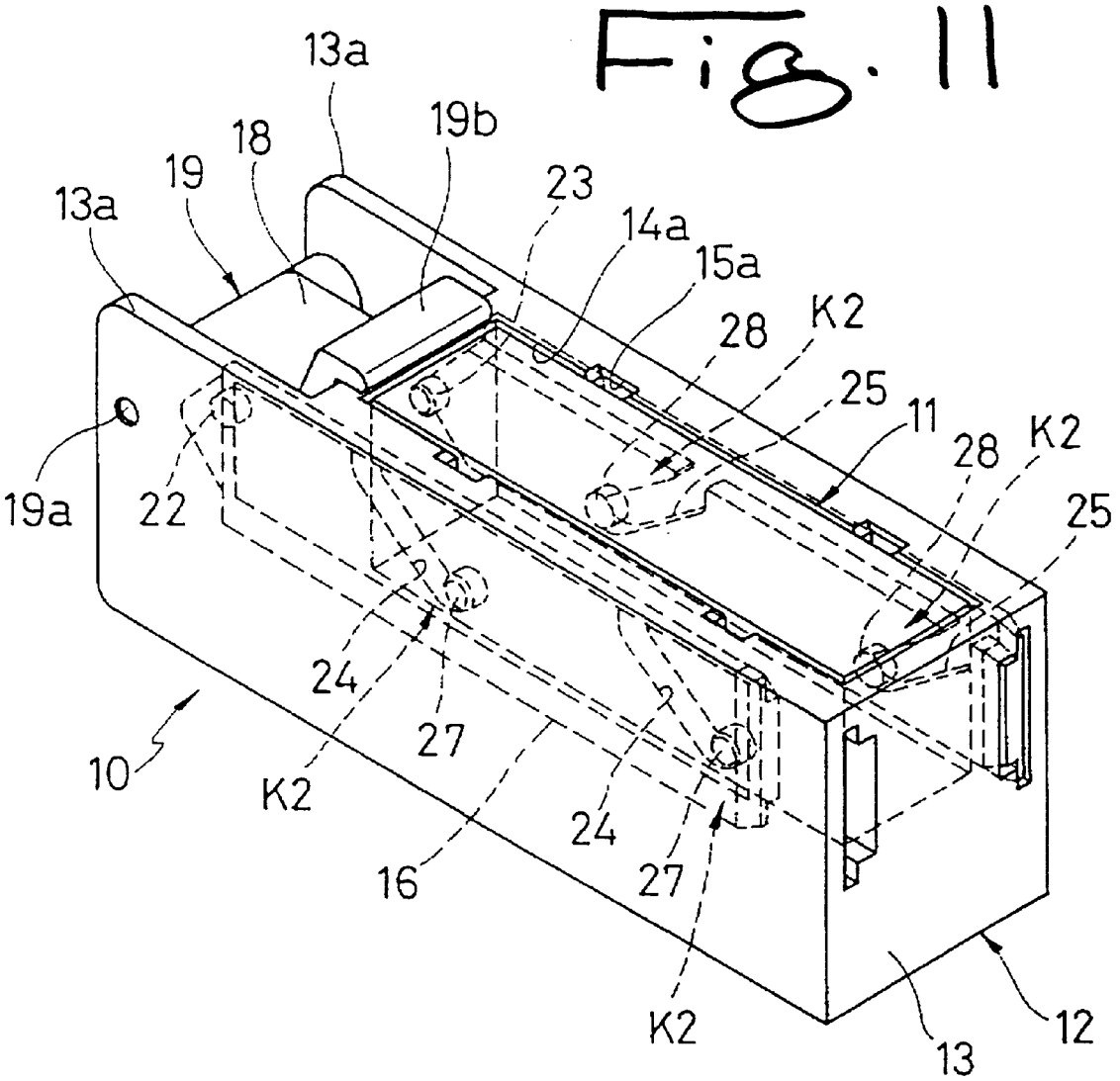
FIG. 11 is a perspective view of the connector mating structure in which the male connector is in the engaged position in accordance with the embodiment of the present invention.
Figure 12:
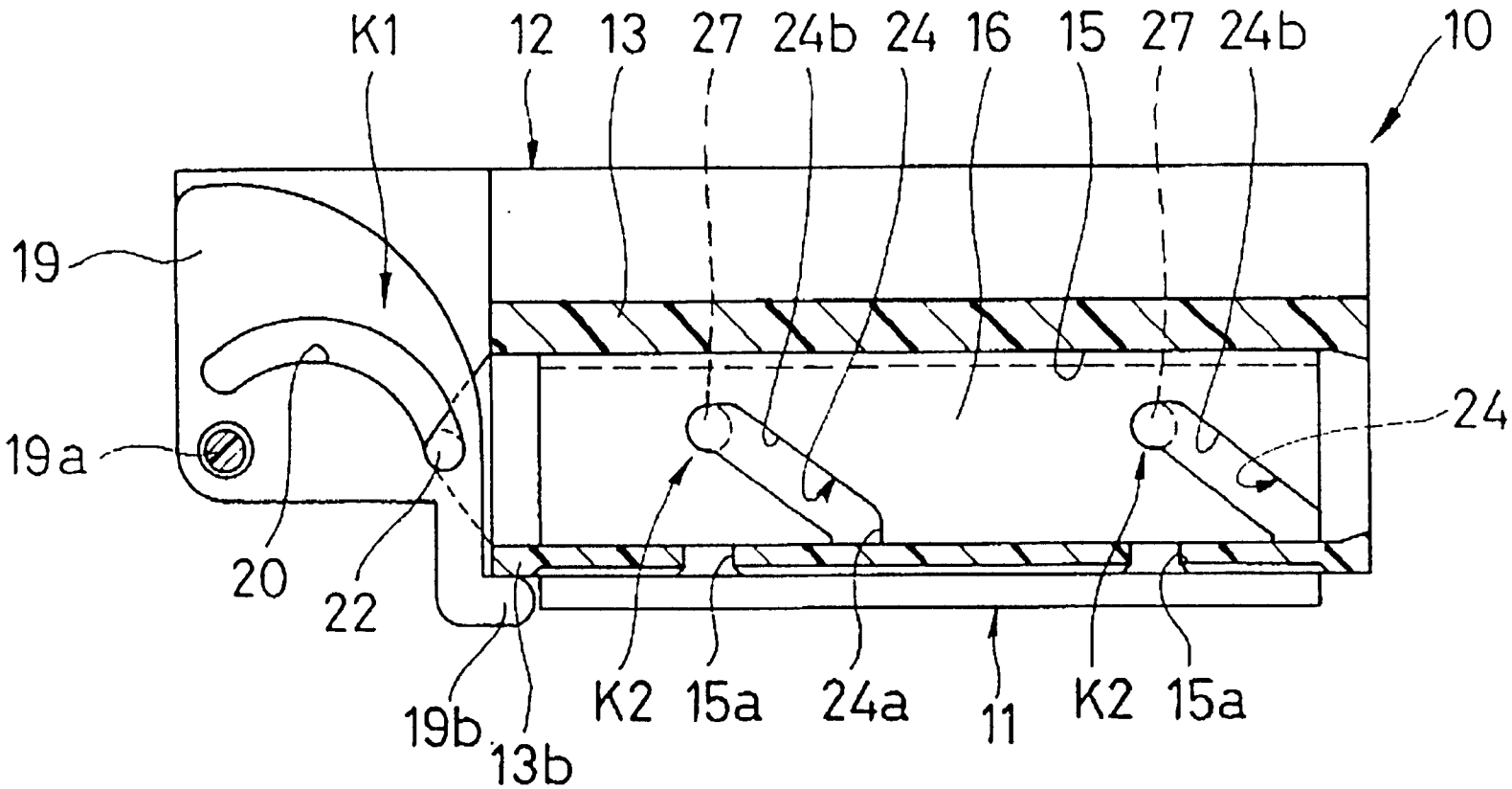
FIG. 12 is a cross-sectional view of the connector mating structure in which the male connector is in the engaged position in accordance with the embodiment of the present invention.
Figure 13:
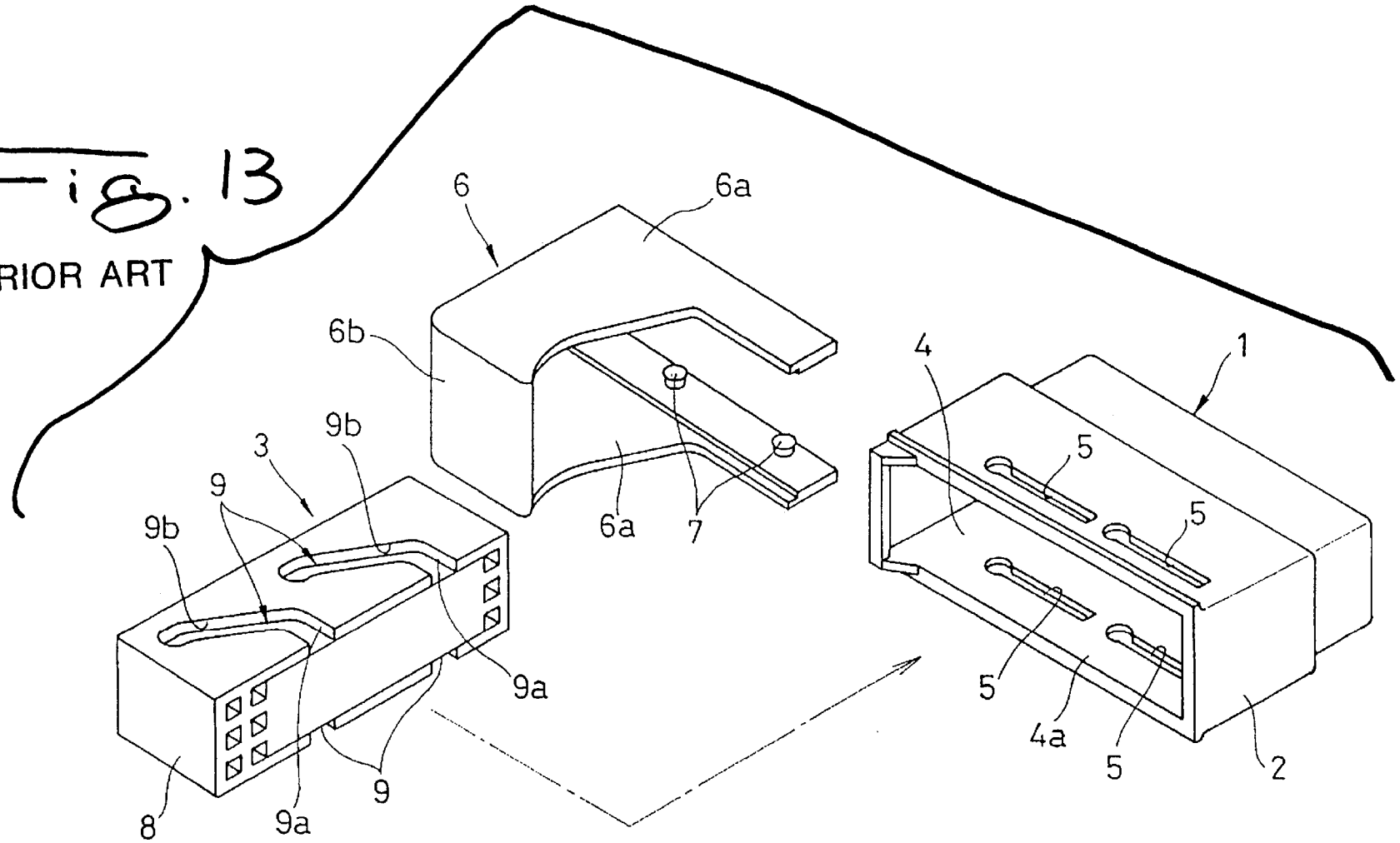
Fig. 13 PRIOR ART
FIG. 13 is a perspective view illustrating a state in which the male connector and the female connector are separated in the related connector mating structure.
Figure 14:
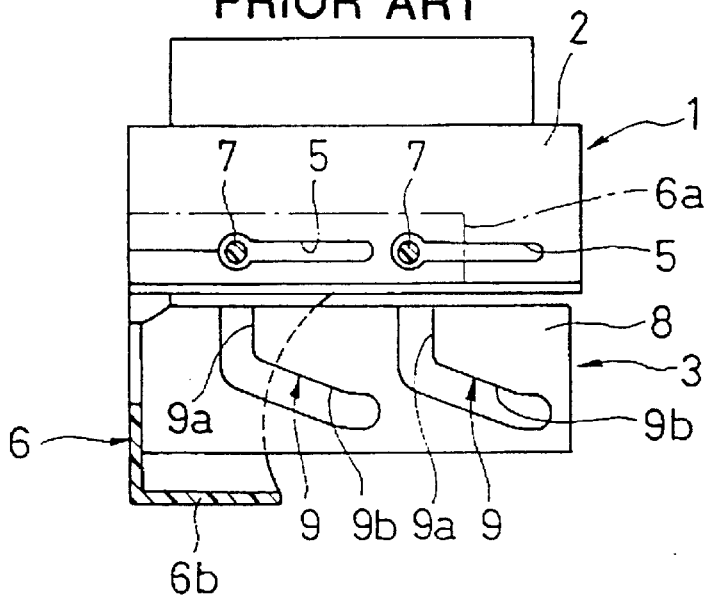
Fig. 14 PRIOR ART
FIG. 14 is a cross-sectional view illustrating an early state of engagement between the male connector and the female connector of the related connector mating structure.
Figure 15:
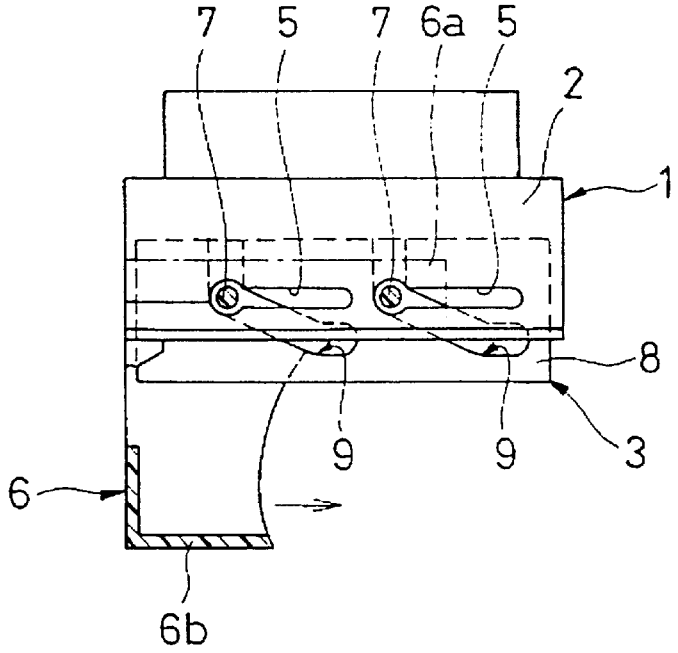
Fig. 15 PRIOR ART
FIG. 15 is a cross-sectional view illustrating an intermediate state of engagement between the male connector and the female connector of the related connector mating structure.
Figure 16:
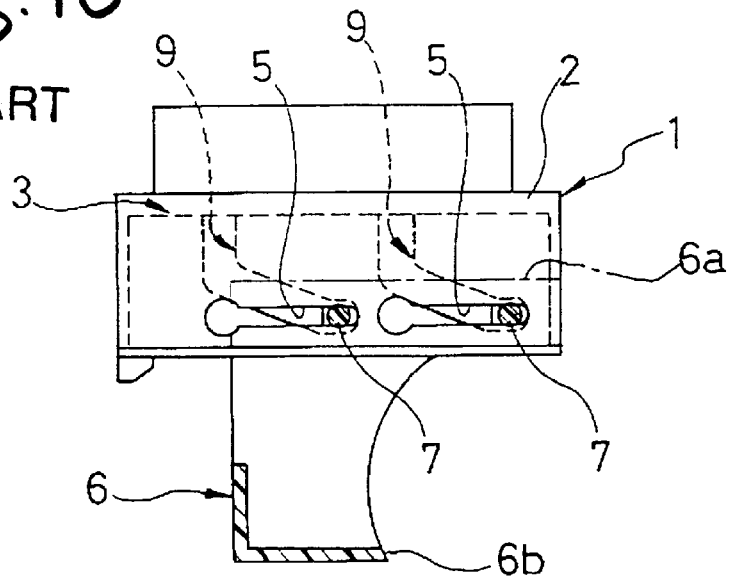
Fig. 16 PRIOR ART
FIG. 16 is a cross-sectional view illustrating a completed state of engagement between the male connector and the female connector of the related connector mating structure.
Figure 17:
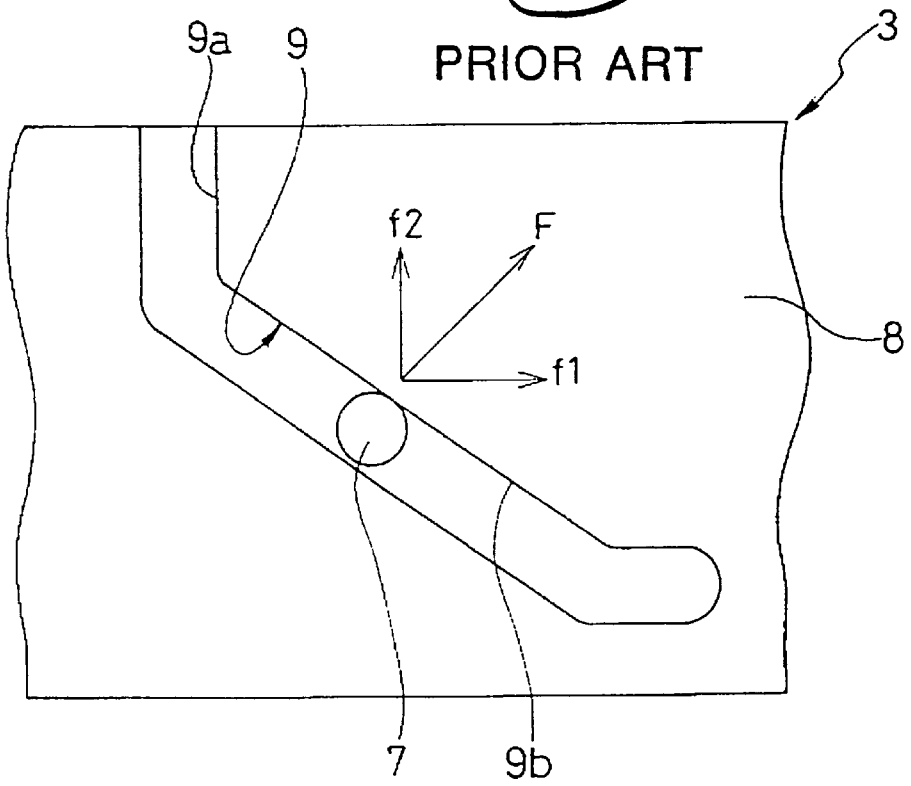
Fig. 17 PRIOR ART
FIG. 17 is a diagram illustrating a pressing direction of the cam mechanisms of the related connector mating structure.

Next, a description will be given of the engaging operation of the above-described connector mating structure with reference to FIGS. 7 to 12. In FIGS. 8, 10, and 12, the first and second cam mechanisms K1 and K2 which are arranged on this side of FIGS. 7, 9, and 11 are shown.

When the operating member 19 is in the operation starting position, if an operator inserts the male connector 11 into the connector accommodating chamber 14 through the inserting port 14*a* of the female housing 13 of the female connector 12, the second cam pins 27 and 28 pass through the guide ports 15*a* and enter the second cam grooves 24 and 25 of the moving members 16 and 17, respectively. Then, as shown in FIGS. 7 and 8, as a result of this insertion, the second cam pins 27 and 28 of the male connector 11 enter the terminating ends (starting ends of the inclined groove portions 24*b* and 25*b*) of the straight groove portions 24*a* and 25*a* of the second cam grooves 24 and 25, i.e., down to the temporary engaged position.

Figure 9:
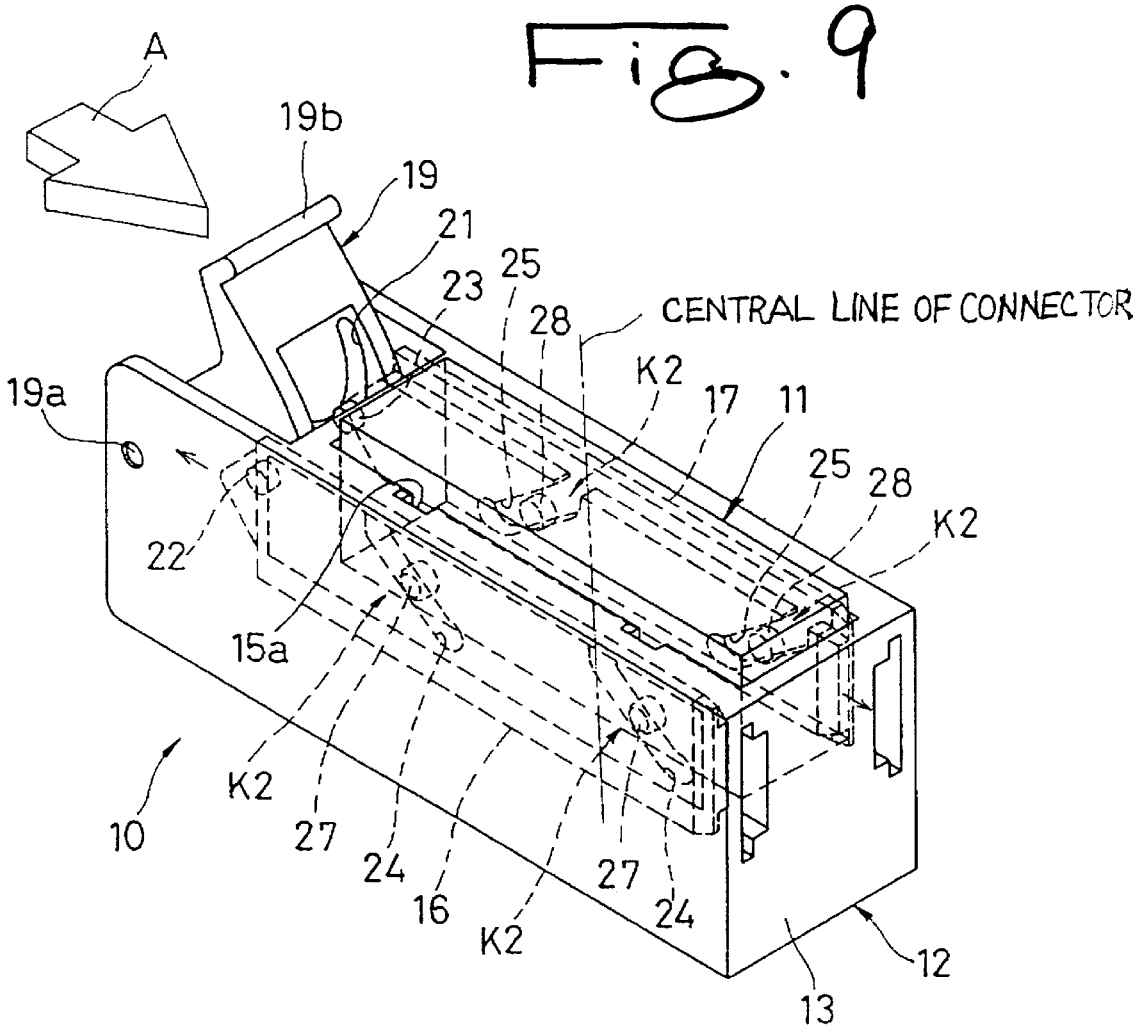
FIG. 9 is a perspective view of the connector mating structure in which the male connector is in an intermediate position between the temporary engaged position and an engaged position in accordance with the embodiment of the present invention.

Next, the operator rotatively operates the operating member 19 toward the operation completed position (in the direction of arrow A in FIG. 9). Then, the first and second moving members 16 and 17 start to move with the first pattern by the first cam mechanisms K1, and, as shown in FIGS. 9 and 10, as the second cam pins 27 and 28 are guided and restricted by the inclined groove portions 24*b* and 25*b* of the second cam grooves 24 and 25, the male connector 11 is inserted into the connector accommodating chamber 14 of the female connector 13. Then, if the operating member 12 is rotated to the operation completed position, as shown in FIGS. 11 and 12, the second cam pins 27 and 28 enter the terminating portions of the inclined groove portions 24*b* and 25*b* of the second cam grooves 24 and 25, and the male connector 11 thus reaches the engagement completed position, thereby completing the engaging operation.

In the above-described engaging operation, during the time from the temporary engaged position to the engagement completed position, on one side surface side of the male connector 11, as shown in FIG. 6A, one second cam pin 27 is subjected to the pressing force F1 by the inclined groove portion 24*b* of the second cam groove 24, and a component fa of this pressing force acts as the inserting force. On the other hand, on the other side surface side of the male connector 11, as shown in FIG. 6B, the other second cam pin 28 is subjected to the pressing force F2 by the inclined groove portion 25*b* of the second cam groove 25, and a component fa of this pressing force acts as the inserting force.

Then, another component fb of the pressing force F1 and another component fc of the pressing force F2 act in the mutually opposite directions, these components of force are offset by each other, so that the male connector 11 as a whole receives only the external force acting in the connector-inserting direction. Accordingly, the engagement of the connectors is effected in a state in which the male connector 11 or the female connector 12 is normally attached to a baseplate or the like, but a trouble such as the occurrence of breakage of an attached portion due to an external force other than the force acting in the connector-inserting direction is prevented from occurring during the engaging operation.

In addition, in the disengaging operation of the connector mating structure, the opposite operation to the above-described operation is effected, i.e., if the operating member 19 is rotatively operated from the operation completed position to the operation starting position, the first and second moving members 16 and 17 move with the second pattern, and the male connector 11 is disengaged up to the temporary engaged position. Therefore, the operator is able to pull out the male connector 11, an external force other than the force acting in the connector-disengaging direction does not act as a whole for the same reason as that described above, so that the trouble such as the occurrence of breakage of the attached portion is prevented from occurring.

In addition, the engaging operation is performed smoothly since the first and second moving members 16 and 17 are disposed at symmetrical positions on both sides of the male connector 11, and since the connector-inserting forces acting on the male connector 11 by the first and second moving members 16 and 17 become uniform on the left- and right-hand sides.

In the above-described engaging operation of the connector, in the process of insertion of the connector from the insertion starting position to the temporary engaged position, since the male terminal and the female terminal are set in a positional relationship in which contact therebetween does not occur, the connector-inserting operation can be performed with a small inserting force, so that the engaging operation can be performed smoothly and easily.

In the above-described engaging operation of the connector, since the operating member 19 is disposed in the accommodating area 18 of the female housing 13, and the operating member 19 is rotated practically within the accommodating area 18 and in such a manner as not to pass through the area located upwardly of the inserting port 14*a*, the operating member 19 does not project into the area located above the inserting port 14*a* or does not move in the upwardly located area. Accordingly, the movement of the operating member 19 does not cause a hindrance to the wire and a jig or the like, and even if the bundle of wires extends from the rear surface of the male connector 11 in the inserting direction, the operating member 19 causes no hindrance, and the possibility of breakage or the like due to contact with another component part is practically nil.

In the above-described engaging operation of the connector, since the cam operation using the first cam mechanisms K1 is guided in the state in which the first cam pins 22 and 23 are inserted in the first cam grooves 20 and 21, the movement of the first cam pins 22 and 23 is effected reliably. Furthermore, since the cam operation using the second cam mechanisms K2 is guided in the state in which the second cam pins 27 and 28 are inserted in the second cam grooves 24 and 25, the movement of the second cam pins 27 and 28 is effected reliably.

It should be noted that although in the above-described embodiment the female connector 12 is provided with the first and second moving members 16 and 17 and the operating member 19, the male connector 11 may be provided with the first and second moving members 16 and 17 and the operating member 19.

Although in the above-described embodiment the pair of first cam mechanisms K1 are arranged such that the operating member 19 is provided with the pair of first cam grooves 20 and 21, and the first and second moving members 16 and 17 are provided with the pair of first cam pins 22 and 23, the operating member 19 may be provided with the pair of first cam pins 22 and 23, and the first and second moving members 16 and 17 may be provided with the pair of cam grooves 20 and 21.

Although in the above-described embodiment the pair of second cam mechanisms K2 are arranged such that the first and second moving members 16 and 17 are respectively provided with the two pairs of cam grooves 24 and 25, and the male connector 11 is provided with the two pairs of second cam pins 27 and 28, the first and second moving members 16 and 17 may be provided with the two pairs of second cam pins 27 and 28, and the male connector 11 may be provided with the two pairs of cam grooves 24 and 25.

Although in the above-described embodiment each of the second cam mechanisms K2 is arranged by providing the second cam grooves 24 and 25 and the second cam pins 27 and 28 at two locations, a connector mating structure of a low inserting force can be obtained by appropriately setting the number of cam grooves and the angle of inclination depending on the type of connector, the number of polarities, and size.

What is claimed is:

1. A connector mating structure, comprising:

a female connector;

a male connector insertable into the female connector;

a first moving member and a second moving member which are disposed within one of the male connector and the female connector and are movable independently from each other;

an operating member pivotally mounted on the one of the male connector and the female connector;

a pair of first cam mechanisms respectively connecting the operating member with the first and second moving members, the first cam mechanisms moving the first and second moving members respectively in mutually opposite directions in accordance with rotation of the operating member; and a pair of second cam mechanisms provided on the first and second moving members and the other one of the male connector and the female connector, the second cam mechanisms moving the other one of the male connector and the female connector in a connector-inserting direction as the first and the second moving members move in the mutually opposite directions, wherein the first cam mechanisms include a pair of spiral shaped grooves which spiral in opposite directions to facilitate the movement of the first and second moving members in opposite directions.

2. The connector mating structure of claim 1, wherein the one of the male connector and the female connector has a connector and the female connector has a connector accommodating chamber for accommodating the other connector within a housing thereof, an inserting port, which allows the other connector to be inserted, is open in the connector accommodating chamber, and accommodating area for accommodating the operating member is formed in the housing, and wherein a path of the rotation of the operating member is set to be mostly within the accommodating area, and the operating member does not pass through an area located above the inserting port.

3. The connector mating structure of claim 2, wherein the male connector is arranged to be insertable into the female connector from an inserting starting position to an engagement completed position through a temporary engaged position, the connector mating structure further comprises terminals accommodated in the male connector and the female connector, wherein the terminals are set to such a positional relationship that contact therebetween does not occur in a process of insertion of the male connector from the inserting starting position to the temporary engaged position, and wherein the insertion of the male connector from the temporary engaged position to the engagement completed position is effected by the rotation of the operating member.

4. The connector mating structure of claim 3, wherein the first and the second moving members are disposed at symmetrical positions on both sides of the one of the male connector and the female connector.

5. The connector mating structure of claim 4, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

6. The connector mating structure of claim 3, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

7. The connector mating structure of claim 2, wherein the first and the second moving members are disposed at symmetrical positions on both sides of the one of the male connector and the female connector.

8. The connector mating structure of claim 2, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

9. The connector mating structure of claim 7, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

10. The connector mating structure of claim 1, wherein the male connector is arranged to be insertable into the female connector from an inserting starting position to an engagement completed position through a temporary engaged position, the connector mating structure further comprises terminals accommodated in the male connector and the female connector, wherein the terminals are set to such a positional relationship that contact therebetween does not occur in a process of insertion of the male connector from the inserting starting position to the temporary engaged position, and wherein the insertion of the male connector from the temporary engaged position to the engagement completed position is effected by the rotation of the operating member.

11. The connector mating structure of claim 10, wherein the first and the second moving members are disposed at symmetrical positions on both sides of the one of the male connector and the female connector.

12. The connector mating structure of claim 11, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

13. The connector mating structure of claim 10, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

14. The connector mating structure of claim 1, wherein the first and the second moving members are disposed at symmetrical positions on both sides of the one of the male connector and the female connector.

15. The connector mating structure of claim 14, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

16. The connector mating structure of claim 1, wherein the pair of first cam mechanisms comprise a pair of first cam grooves provided in one of the operating member and the first and the second moving members, and a pair of first cam pins provided in the other one of the operating member and the first and the second moving members and arranged to be inserted into the pair of first cam grooves.

17. The connector mating structure according to any one of claims 1 to 5, wherein the pair of second cam mechanisms comprise a pair of second cam grooves provided in one of the first and the second moving members and the other one of the male connector and the female connector, and a pair of second cam pins provided in the other one of the first and the second moving members and the other one of the male connector and the female connector and arranged to be inserted into the pair of second cam grooves.

* * * * *